United States Patent [19]

Reist et al

[11] Patent Number: 4,471,953

[45] Date of Patent: Sep. 18, 1984

[54] DEVICE FOR SUPERPOSING INDIVIDUAL SUBSTANTIALLY FLAT PRODUCTS, IN PARTICULAR PRINTED PRODUCTS

[75] Inventors: Walter Reist, Hinwil; Werner Honegger, Tann-Rüti, both of Switzerland

[73] Assignee: Ferag AG, Hinwil, Switzerland

[21] Appl. No.: 325,905

[22] Filed: Nov. 30, 1981

[30] Foreign Application Priority Data

Dec. 11, 1980 [CH] Switzerland ..... 9158/80

[51] Int. Cl.[3] ..... B65H 39/02

[52] U.S. Cl. ..... 270/54; 198/644; 270/58

[58] Field of Search ..... 270/54–58; 198/644, 650

[56] References Cited

U.S. PATENT DOCUMENTS 3,122,362 2/1964 Vollrath ..... 270/58 X 3,953,017 4/1976 Wise ..... 270/58 X

*Primary Examiner*—A. J. Heinz

*Attorney, Agent, or Firm*—Werner W. Kleeman

[57] ABSTRACT

A collecting conveyor (1) runs through a plurality of deposit stations (2, 3, 4) which are disposed one behind the other in the conveying direction (A) of the collecting conveyor (1). Printed products are continuously supplied from a related stack (8, 9, 10) to each deposit station (2, 3, 4) by means of a related single conveyor (5, 6, 7). Each single conveyor (5, 6, 7) comprises a plurality of gripping devices which are disposed one behind the other and can be controlled individually. At the deposit stations (2, 3, 4) these gripping devices are now opened whereby the released printed products are deposited on the collecting conveyor (1) which is situated therebelow. This collecting conveyor (1) is likewise provided with controllable gripping devices which seize and entrain the deposited printed prducts. At each deposit station (2, 3, 4) the printed products are placed over the printed product or products previously deposited on the collecting conveyor (1). The piles of superposed printed products are delivered to a processing station (11). In this manner the printed products may be collected or gathered together without stacking of these printed products being necessary at the deposit stations (2, 3, 4).

12 Claims, 4 Drawing Figures

DEVICE FOR SUPERPOSING INDIVIDUAL SUBSTANTIALLY FLAT PRODUCTS, IN PARTICULAR PRINTED PRODUCTS

BACKGROUND OF THE INVENTION

This invention relates to a device for superposing individual substantially flat products and in particular printed products. Such a device has a collecting conveyor provided with entrainment members disposed at intervals and which runs through at least two deposit stations disposed behind each other in the conveying direction of the collecting conveyor. At these stations the individual products delivered are deposited onto the collecting conveyor.

In the case of known collecting or gathering devices of this type stacks of printed products are located at the individual deposit stations from which stacks the individual printed products are removed and deposited on a collecting chain or belt, or onto the previously superposed products. The individual piles of superposed products, disposed at a mutual spacing are delivered to a station where they are further processed.

In the case of these known solutions it is necessary to stack the printed products to be deposited at the deposit stations or to convey the printed products in an already stacked disposition from a stacker station, which is disposed at a distance, to the deposit station, which involves corresponding expense.

SUMMARY OF THE INVENTION

The present invention is intended to provide a device of the already mentioned type, in which it is not necessary to form stacks of products to be superposed at the deposit stations.

In accordance with the invention such a device is characterised by single conveyors which are associated with each of the deposit stations and convey products thereto, and which comprise controllable gripping devices disposed one behind the other and extending in the region of the associated deposit station above the collecting conveyor and have a conveying direction which is substantially in the same direction as the conveying direction of the collecting conveyor, and means for bringing the trailing edge of the products delivered by the single conveyors into the operative region of the entrainment members of the collecting conveyor.

The products are conveyed by means of the single conveyor to the appropriate deposit station and there they are deposited onto the collecting conveyor or onto the products which have already been disposed thereon, by opening the gripping device. Thus a preceding stack formation in the region of the deposit stations is not required. Furthermore it is possible to form groups of collected products on the collecting conveyor in imbricated formation.

BRIEF DESCRIPTION OF THE DRAWINGS

One embodiment of the invention is hereinafter described in greater detail with reference to the accompanying drawings in which.

DETAILED DESCRIPTION OF THE PREFERRED EMBODIMENTS

Figure 1:
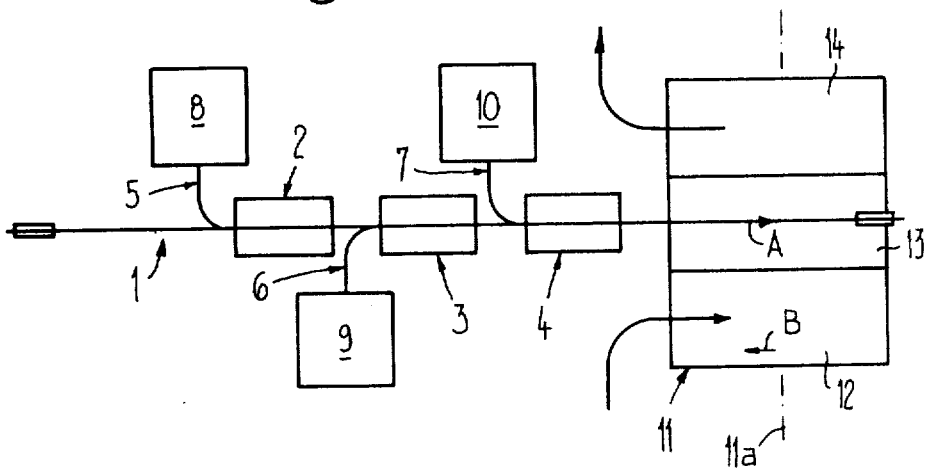
FIG. 1 is a plan view showing purely schematically a collection path with three deposit stations.

The construction of a collecting path will firstly be explained with reference to the schematic illustration of FIG. 1, which shows an endless collecting conveyor 1, the construction of which will be explained in greater detail with reference to FIGS. 2 to 4. In the conveying direction A of the collecting conveyor 1 three deposit stations 2, 3 and 4 are disposed one after the other, through which the collecting conveyor 1 runs. At these deposit stations 2, 3 and 4, in a manner yet to be described, individual products are deposited on the collecting conveyor 1 and are delivered to these deposit stations 2, 3, 4 by means of single conveyers 5, 6 and 7 respectively. The construction of these single conveyors 5, 6, 7 will be described in further detail with reference to FIGS. 2 to 4. The single conveyors 5, 6, 7 pick up the products from stacks 8, 9 and 10, respectively, which may be located at any suitable point. It is of course also possible to convey the products to the deposit stations 2, 3, 4 from a different type of product source instead of from the stacks 8, 9 and 10.

The collecting conveyor 1 conveys the piles of products which have been placed one on top of the other at the deposit stations 2, 3, 4 to an insertion drum 11 having a known structure, as disclosed for example in U.S. Pat. No. 3,951,399. This insertion drum 11 comprises an input section 12, an insertion section 13 and a removal section 14 and is rotatably driven about its axis 11*a* in the direction of the arrow B. Each of the three drum sections 12, 13, 14 has radial sections which are externally open and are not shown in FIG. 1. As has been clearly explained in the above-mentioned patent main printed products are inserted into the compartments of the input section 12 and are displaced into the insertion section 13 during rotation of the insertion drum 11. During this displacement the main products are opened. In the insertion section 13 the piles of superposed products (inserts) delivered by the collecting conveyor 1 are inserted into the opened main products. Subsequently the main products, together with the inserts pass into the removal section 14 from which they are removed.

Figure 2:
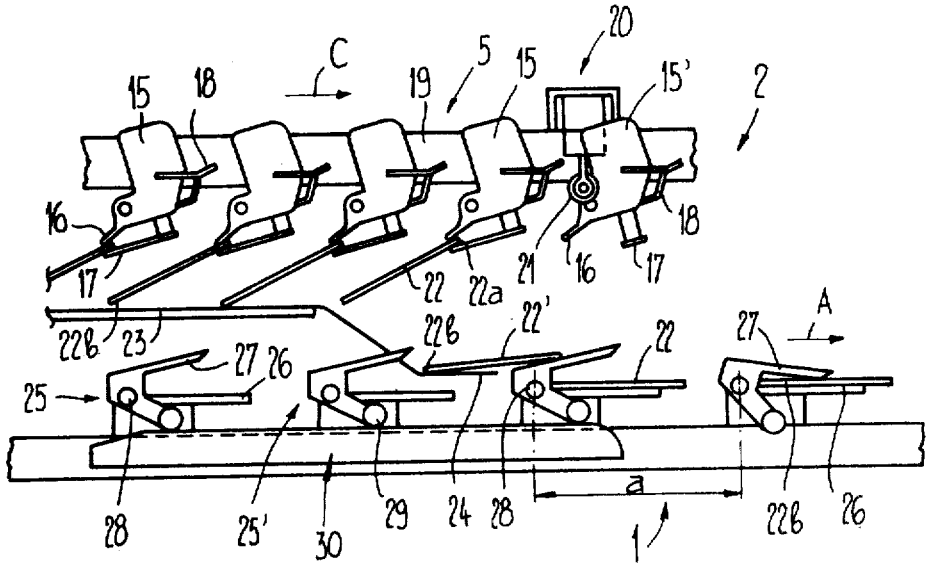
FIGS. 2 to 4 are schematic lateral views of each of the three deposit stations.
Figure 3:
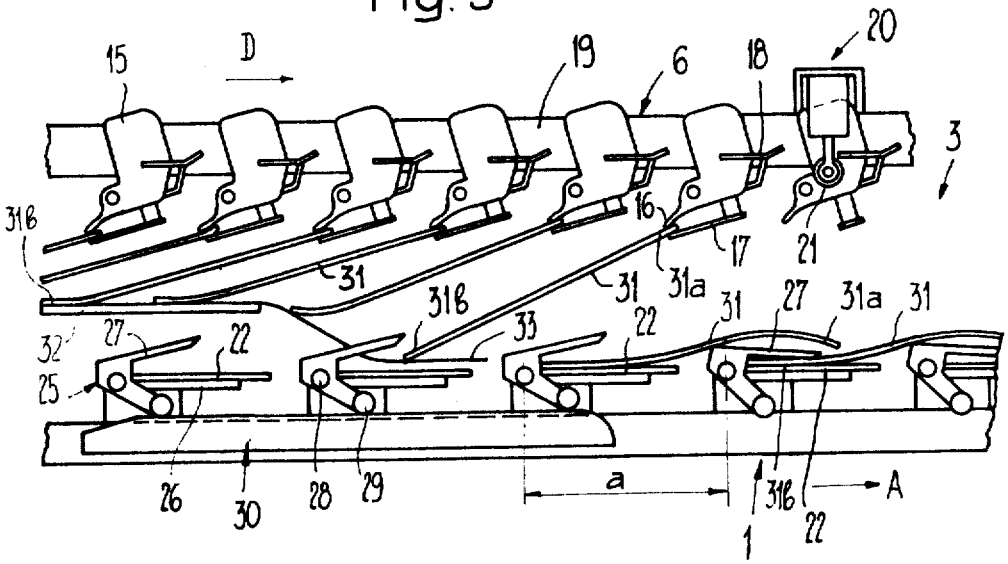
Figure 4:
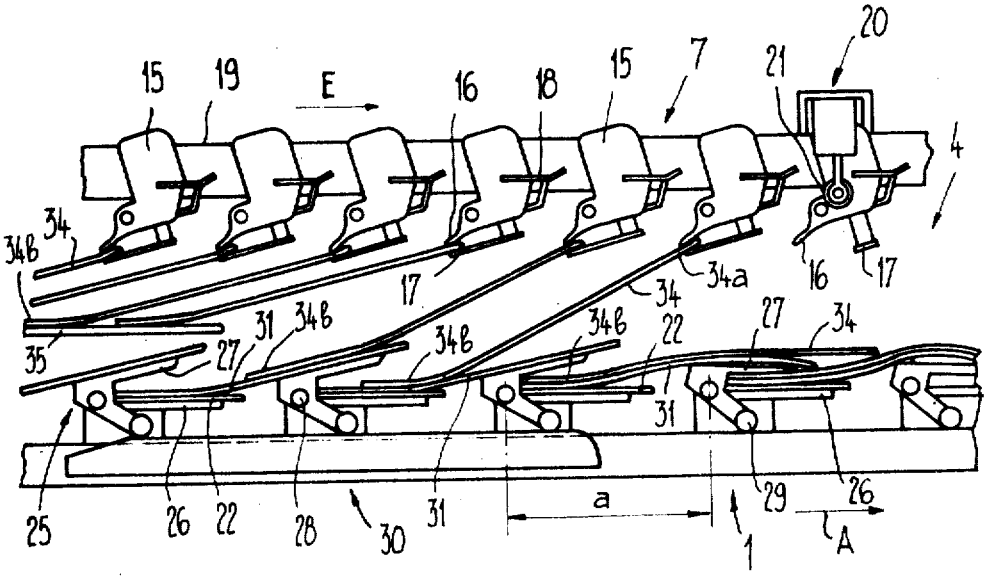

Referring now to FIGS. 2 to 4 the deposition of the printed products one on top of the other in the deposit stations 2, 3 and 4 will be hereafter explained.

As is shown in FIG. 2, which is a side view of the deposit station 2, the single conveyor 5, known per se, comprises individual gripping devices 15 which are disposed one behind the other in the conveying direction C of the conveyor 5. Each gripping device 15 comprises a fixed clamping jaw 16 and a pivotable clamping jaw 17. By means of a locking lever 18 the latter is retained in its clamping position in which it cooperates with the fixed clamping jaw 16. The gripping devices 15 are secured to a chain (not shown) which is guided in the interior of a guide channel 19. For a precise description of the construction of the single conveyor 5 reference should be made to U.S. Pat. No. 3,955,667.

In order to open the gripping devices 15, a releasing device 20 is disposed at the deposit station 2 and bears a releasing roller 21. As is explained in greater detail in the last above-mentioned patent the releasing roller 21 causes the locking lever 18 to be lifted when each gripping device runs past, the result of this being that the clamping jaw 17 is unlocked and is laterally withdrawn, as is illustrated in FIG. 2, relative to the gripping device 15' which has already run past the releasing device 20.

In the clamping position of the movable clamping jaw 17 the leading edge 22*a* of a printed product 22 is clamped between the movable clamping jaw 17 and the fixed clamping jaw 16 and is transported in a suspended manner from the stack 8 to the deposit station 2. In the region of this deposit station 2 the trailing edge 22*b* of the printed products comes to rest on a table 23 disposed below the conveyor 5. An imbricated formation is thereby produced from the printed products 22.

Viewed in the conveying direction C of the conveyor 5 the table 23 is followed by a support element 24 which preferably is formed from spring steel. This support element 24 is located in the path of travel of gripping devices 25 of the collecting conveyor 1. These gripping devices 25 are disposed one behind the other in the conveying direction A of the collecting conveyor 1 and comprise a lower, rigid gripping jaw 26 and an upper gripping jaw 27 which may be pivoted about a swivel axis 28. On one arm of the movable gripping jaw 27 there is secured a control roller 29 which cooperates with a slide block or cam 30, disposed in the deposit station 2, in order to displace the gripping jaw 27 upwards and thus to open the gripping device 25. The upper gripping jaw 27 is retained in its clamping position in a manner which is not shown, for example by means of a spring. The upper clamping jaw 27 is in the form of a fork and thus comprises two clamping fingers which extend parallel to each other and at a mutual spacing. The support element 24 consists of three sections each of which extends laterally and between the gripping fingers.

The delivery of the printed products 22 from the single conveyor 5, which extends in the region of the deposit station 2 above the collecting conveyor 1 and has a conveying direction C which is in the same direction as the conveying direction A of the collecting conveyor 1, to this collecting conveyor 1 takes place as follows:

When running past the releasing device 20, the gripping devices 15 are opened in the manner already described, as a result of the fact that the movable clamping jaw 17 pivots laterally out of the path. The printed products thereby released come to rest, as is shown by reference to the printed product 22', at least at the region of their trailing edge 22*b*, on the support element 24. Depending on its size, the printed product 22' comes to rest, as is shown in FIG. 2, on the gripping jaw 27 of one gripping device 25. In the case of small printed products 22 however, it is also possible that the entire printed product rests on the support element 24. If necessary the support element 24 may have a suitable friction lining in order to prevent the entrainment of the printed product 22' resting on a gripping device 25.

The printed product 22' resting on the support element 24 is now collected by a gripping device 25', which is opened by the slide block 30, and is gripped at its trailing edge 22*b* by the gripping device 25' and entrained. In this case the printed product 22' is moved away from the support element 24 and comes to lie on the lower gripping jaw 26. The control roller 29 of the gripping device 25 subsequently runs off the slide block 30 which now results in closing of the upper gripping jaw 27. The printed product 22 is now secured between the gripping jaws 26 and 27 and conveyed to the second deposit station 3 by means of the collection conveyor 1. This deposit station 3 is shown schematically in FIG. 3.

This second deposit station 3 is constructed in a similar manner to the already described first deposit station 2. The printed products 31 are delivered by means of a related single or individual conveyor 6, the structure and function of which correspond to the single or individual conveyor 5. The printed products 31 advanced from the stack 9 are likewise secured at their leading edge 31*a* by means of the clamping jaws 16 and 17. The delivered printed products 31 come to rest with their trailing edge 31*b* on a table 32, whereby an imbricated formation is produced from these printed products, in which formation each printed product partially covers the preceding printed product. The table 32 is likewise followed by a support element 33 which, like the support element 24 of the station 2, is disposed in the path of travel of the gripping devices 25 of the collecting conveyor 1. This support element 33 extends laterally and between the clamping fingers of the movable gripping jaw 27 of each of the gripping devices 25.

As can be seen from FIG. 3, the printed products 31 are larger than the printed products 22, so that the printed products 31 resting with their trailing edge 31*b* on the support element 33 may be retained by the associated gripping device 15 until one gripping device 25 of the collecting conveyor 1 seizes the printed product 31 at its rear edge 31*b*. At this moment the gripping device 15 is opened in the described manner by the releasing device 20. As a result of the lateral movement away of the movable clamping jaw 17 the printed product 31 is also immediately released so that it may be entrained by the corresponding gripping device 25 of the collecting conveyor 1 without damage. The released printed product 31 comes to rest on the printed product 22 deposited in the deposit station 2. Since the printed product 31 in the conveying direction A of the collecting conveyor 1 has a length which is greater than the distance a between the gripping devices 25 of the collecting conveyor 1, the printed product 31 is further supported on the movable gripping jaw 27 of the preceding gripping device, as FIG. 3 shows. After the control roller 29 has run off the slide block or cam 30, the movable gripping jaw 27 is conveyed into the clamping position in which it clamps the two superposed printed products 22 and 31.

Since the printed products 31, as already mentioned above, are secured by the gripping devices 15 until the moment of entrainment by the gripping devices 25 of the collecting conveyor 1 and do not previously come to rest either on the gripping devices 25 or on the printed products 22, entrained by these gripping devices 25, a premature and undesired entrainment of the printed products 31 by the collecting conveyor 1 is avoided. In the case of printed products which have a larger format than the printed products 31 shown in FIG. 3 the danger of an early entrainment of this type can nevertheless exist in certain circumstances. In this case, in a manner similar to what was described with reference to the deposit station 2, the support element 33 may have a suitable friction lining.

The collecting conveyor 1 now brings the superposed printed products 22 and 31 to the third deposit station 4 which is illustrated in FIG. 4. This third deposit station 4 is essentially constructed in the same manner as the previous deposit stations 2 and 3.

The single conveyor 7 which transports the printed products 34 from the stack 10 to the deposit station 4 is constructed in the same manner as the two single conveyors 5 and 6. The printed products 34 to be transported are secured at their leading edge 34*a* by means of clamping jaws 16 and 17. In the region of the deposit station 4 the trailing edge 34*b* of the printed products 34 comes to rest on a table 35, whereby an imbricated formation is created, in the same manner as in stations 2 and 3. Since the printed products 31 deposited at the deposit station 3 cover the preceding gripping device 25 of the collecting conveyor 1 in each case (FIG. 3), it is not necessary to provide a support element at the deposit station 4 corresponding to the support elements 24 and 33. As soon as the trailing edges 34*b* of the printed products 34 run off the table 35 they come to rest on a printed product which has been delivered by the collecting conveyor 1, as is shown in FIG. 4. In order to avoid also in this case that the printed product 34 is carried away by frictional entrainment by the collecting conveyor 1 before its trailing edge 34*b* passes into the operative area of a gripping device 25 of the collecting conveyor 1, the corresponding printed product 34 is secured by the associated gripping device 15 until the corresponding gripping device 25 of the collecting conveyor 1 has picked up the printed product 34, that is, until the trailing edge 34*b* of the printed product reaches the operative area of the gripping device 25.

As a result of the swinging upwards of the pivotable gripping jaws 27 of the collecting conveyor 1 upon opening the gripping device 25, the printed product 31 resting on these gripping jaws 27 is also lifted, whereby an opening is formed between the printed products 31 which overlap each other in an imbricated manner, into which opening the next printed products 34 to be deposited may be inserted. In this manner it is thus also possible to deposit further printed products on printed products arriving in an imbricated formation.

As soon as the trailing edge 34*b* of a printed product 34 is entrained by a gripping device 25 the corresponding gripping device 15 of the single conveyor 7 is opened by the releasing device 20, which, in the manner described, results in a lateral swinging away of the movable clamping jaw 17 and thus an immediate release of the printed product 34. The released printed product 34 is deposited on the printed product 31. As soon as the control roller 29 leaves the operative area of the slide block or cam 30, the upper gripping jaw 27 is pivoted into the clamping position in which all three superposed printed products 22, 31 and 34 are secured. The collecting conveyor 1 now conveys the piles, which in each case consists of the three printed products 22, 31, 34 lying one on top of the other, to the insertion section 13 of the insertion drum 11 (FIG. 1). As already mentioned, in each case one of these piles is inserted in an opened main printed product, as is explained in greater detail in the already-mentioned U.S. Pat. No. 3,951,399.

It follows from the above description that various measures are taken in order to convey the delivered products 22, 31, 34 into the operative region of the opened gripping devices 25 of the collecting conveyor 1. In one instance the trailing edges 22*b*, 31*b* and 34*b* of the printed products 22, 31, 34 are inserted into the path of travel of the gripping devices 25. This occurs at the deposit stations 2 and 3 by means of support elements 24 and 33 and at the deposit station 4 by the deposition of the printed products 34 on a printed product 31 which has been deposited on the collecting conveyor 1 at the preceding deposit station 3. Furthermore it must be ensured that the printed products 22, 31 and 34 can be collected and entrained by the gripping devices 25 of the collecting conveyor 1. Before they are entrained by these devices 25 the printed products 22, 31 and 34 must have a velocity component in the conveying direction A of the collecting conveyor 1 which is smaller than the conveying speed of the collecting conveyor 1. In the embodiment illustrated, the conveying speed or velocity of the collecting conveyor 1 is therefore greater than the conveying speeds of the single conveyors 5, 6 and 7. Finally the printed products 22, 31, 34 must still be prevented from being entrained by the collecting conveyor 1 before their trailing edge passes into the operative region of the gripping devices 25 of this collecting conveyor 1. This may take place in various ways. For example the support element 24 may have a friction lining, as was described with reference to FIG. 2. By means of the friction lining the friction between the printed product 22' and the support element 24 is maintained greater than the friction between the product 22' and the gripping jaw 27 on which the printed product 22' is deposited. Another possibility for preventing premature entrainment of the printed products consists in the printed products being retained by the gripping devices 15 of the single conveyors until the trailing edge of the printed products is seized by the gripping devices 25 of the collecting conveyor 1. In the case of a solution of this type, as was explained with reference to FIGS. 3 and 4, it is necessary that when the gripping devices 15 are opened the printed products are immediately released. In the case of the single conveyors 5, 6, 7 used in the illustrated embodiment this immediate release is ensured by the lateral swinging away of the movable clamping jaw 17. In the case of another type of construction of the gripper devices 15 it may, however, be necessary after releasing the gripper devices, i.e. after the releasing device 20, to lead the single conveyor away in an upward direction in order to be able to release the printed products immediately. Apart from these abovementioned measures a premature entrainment of the printed products 22, 31, 34 may be prevented in other suitable ways. It is thus conceivable, for example, to provide rollers or brushes at the side of the delivered printed products 22, 31, 34, which rollers or brushes exert on the printed product released in each case by the gripping devices 15 a conveying effect which is directed backwards, i.e. against the arriving gripping devices 25 of the collecting conveyor 1.

As was described with reference to FIG. 4, when the gripping devices 25 open, the printed products 31 deposited on the upper gripping jaws 27 thereof are lifted in order to form an opening between the overlapping printed products 31, into which opening one printed product 34 may be inserted in each case. If the printed products have sufficient inherent rigidity these printed products 31 are only lifted off the preceding printed product 31 by deposition onto the preceding gripping device 25. The lifting of the printed products 31, caused by the swinging upwards of the movable gripping jaws 27 to form the above-mentioned opening is not necessary in this case.

It is to be understood that in the above-mentioned manner printed products having a format different from that shown in FIGS. 2 to 4 also be superposed. The deposit stations 2, 3, 4 must be constructed so as to correspond to the format. If, for example, only printed products which correspond in format to the printed products 22 are processed, each deposit station should be equipped with a support element 24 or 33. On the other hand, if at the first deposit station 2 printed products of the size of the printed products 31 or 34 are already deposited then it is no longer necessary to provide support elements 33 at the following stations. The superposing of the printed products at the stations following the first deposit station then occurs in the manner described with reference to FIG. 4. The number of printed products to be placed on top of each other can be selected optionally per se. A deposit station of the type described should be provided for each product to be deposited.

Instead of having gripping devices 25 the collecting conveyor 1 may also be equipped only with an entrainment cam which, by abutting against the trailing edge of the delivered printed products, entrains the latter. The disadvantage of this type of embodiment in comparison with a collecting conveyor 1 equipped with gripping devices 25 is that the printed products cannot be secured, which renders impossible the optional guiding of the collecting conveyor 1 in space.

As was explained with reference to FIG. 1, the piles consisting of three printed products 22, 31, 34 lying one on top of the other are delivered to the insertion section 13 of an insertion drum 11. It is thus possible to place three inserts simultaneously in the main printed product in one insertion process.

In the case where each insert 22, 31 and 34 is delivered to its own insertion section of the insertion drum 11 there thus results, on the one hand, a reduction of the insertion drum 11 and an increase in the efficiency of the insertion drum 11 without the processing speed having to be increased.

It is obviously also possible to deliver the piles of superposed printed products 22, 31, 34 to any other processing device, e.g. to a binding machine. It is further possible to convey by means of each gripping device 15 of the single conveyor 5, 6, 7 more than only one printed product to the deposit stations 2, 3, 4. At these deposit stations all the printed products retained by one gripping device 15 are transferred together to the collecting conveyor 1 in the manner described.

While there are shown and described present preferred embodiments of the invention, it is to be distinctly understood that the invention is not limited thereto, but may be otherwise variously embodied and practiced within the scope of the following claims. Accordingly,

What we claim is:

1. A device for superposing individual substantially flat products, comprising:

at least two product deposit stations arranged one behind the other;

a collecting conveyor having entrainment members disposed at intervals thereon, each said entrainment member being operatively associated with a receiving surface for supporting the flat products in superposed relationship one on top of the other and defining a related operative region;

said collecting conveyor running in a predetermined conveying direction through said deposit stations for receiving products on said receiving surfaces;

a predetermined number of linearly extending single conveyors, each of which is operatively associated with a related one of said deposit stations for conveying thereto the products which have a leading edge and a trailing edge, and for depositing said products on said collecting conveyor;

each said single conveyor comprising:

controllable gripping devices disposed one behind the other and extending in the region of the associated deposit station above the collecting conveyor;

the gripping devices having a conveyance direction which is substantially in the same direction as the conveying direction of the collecting conveyor; and means for bringing the trailing edge of the products delivered by the single conveyors into the operative region of the entrainment members of the collecting conveyor.

2. A device as claimed in claim 1, further including:

means for driving said collecting conveyor at a predetermined conveying speed in the conveying direction thereof;

means for driving each said single conveyor at a predetermined conveyance speed in said conveyance direction so that the products assume a speed substantially equal to said conveyance speed of the related single conveyor; and means for ensuring that before the products are entrained by the entrainment members, the conveying speed of the collecting conveyor is greater than the speed of the products to be deposited in the conveying direction of the collecting conveyor.

3. A device as claimed in claim 1, further including means for restraining or preventing the entrainment of the products deposited on the collecting conveyor before they are seized by the entrainment members.

4. A device as claimed in claim 1, wherein a first deposit station of said at least two deposit stations comprises a support which extends into the path of travel of the entrainment members for the product to be deposited onto the collecting conveyor in each case.

5. A device as claimed in claim 1, further including releasing devices disposed at the deposit stations and which open the gripping devices of the associated conveyor only when the trailing edge of the corresponding product is located in an operating region of an entrainment member.

6. A device as claimed in claim 1, wherein each entrainment member forms a support for the products which overlap it and are seized by the following entrainment member by means of which these deposited products may be lifted from the preceding products.

7. A device as claimed in claim 1, wherein said entrainment members comprise controlled gripping devices.

8. A device as claimed in claim 1, wherein the distance between the entrainment members of the collecting conveyor is smaller than the dimension of at least one part of the products in the conveying direction.

9. A device as defined in claim 1, wherein:

said entrainment members comprise controlled gripping devices each having an upper gripping jaw which is upwardly pivotable in order to open the related gripping device.

10. A device as defined in claim 1, wherein:

said single conveyors coact with said collecting conveyor such that at the operative region of each entrainment member at least two products are deposited into each entrainment member in superposed relationship one on top of the other so as to extend substantially parallel to said predetermined conveying direction of said collecting conveyor.

11. The device as defined in claim 1, wherein:

said collecting conveyor defines a single collecting conveyor.

12. A device for superposing individual substantially flat products comprising:

at least two product deposit stations;

a collecting conveyor which runs through the deposit stations in a predetermined conveying direction and has entrainment members disposed at intervals thereon, each said entrainment member defining a related operative region;

a predetermined number of single conveyors each of which is operatively associated with a related one of said deposit stations for conveying thereto the products which have a trailing edge and for depositing said products on said collecting conveyor;

each said single conveyor comprising:

controllable gripping devices disposed one behind the other and extending in the region of the associated deposit station above the collecting conveyor;

the gripping devices having a conveyance direction which is substantially in the same direction as the conveying direction of the collecting conveyor;

means for bringing the trailing edge of the products delivered by the single conveyors into the operative region of the entrainment members of the collecting conveyor; and said entrainment members comprising controlled gripping devices each having an upper gripping jaw which is upwardly pivotable in order to open the related gripping device.

* * * * *

US004471953B1

REEXAMINATION CERTIFICATE (1710th)

United States Patent [19]

Reist et al.

[11] B1 4,471,953

[45] Certificate Issued Jun. 2, 1992

[54] DEVICE FOR SUPERPOSING INDIVIDUAL SUBSTANTIALLY FLAT PRODUCTS, IN PARTICULAR PRINTED PRODUCTS

[75] Inventors: Walter Reist, Hinwil; Werner Honegger, Tann-Rüti, both of Switzerland

[73] Assignee: Ferag AG, Hinwil, Switzerland

Reexamination Request:
No. 90/002,382, Jun. 28, 1991

Reexamination Certificate for:

| | |
|---|---|
| Patent No.: | 4,471,953 |
| Issued: | Sep. 18, 1984 |
| Appl. No.: | 325,905 |
| Filed: | Nov. 30, 1981 |

[30] Foreign Application Priority Data

Dec. 11, 1980 [CH] Switzerland ..... 9158/80

[51] Int. Cl.[5] ..... B65H 39/02

[52] U.S. Cl. ..... 270/54; 198/644; 270/58

[58] Field of Search ..... 270/54-58; 198/644, 650

[56] References Cited

U.S. PATENT DOCUMENTS

| | | |
|---|---|---|
| 3,122,362 | 2/1964 | Vollrath et al. . |
| 3,825,247 | 7/1974 | Fernandez-Rana et al. . |
| 3,951,399 | 4/1976 | Reist . |
| 3,953,017 | 4/1976 | Wise . |
| 3,955,667 | 5/1976 | Muller et al. . |
| 3,966,186 | 6/1976 | Helm . |
| 4,039,182 | 8/1977 | Reist et al. . |
| 4,201,286 | 5/1980 | Meier . |

FOREIGN PATENT DOCUMENTS

| | | |
|---|---|---|
| 1254581 | 11/1967 | Fed. Rep. of Germany . |
| 1786065 | 2/1972 | Fed. Rep. of Germany . |
| 2410993 | 9/1974 | Fed. Rep. of Germany . |
| 2456908 | 12/1976 | Fed. Rep. of Germany . |
| 1279180 | 6/1972 | United Kingdom . |
| 1585428 | 3/1981 | United Kingdom . |

*Primary Examiner*—Edward Look

[57] ABSTRACT

A collecting conveyor (1) runs through a plurality of deposit stations (2, 3, 4) which are disposed one behind the other in the conveying direction (A) of the collecting conveyor (1). Printed products are continuously supplied from a related stack (8, 9, 10) to each deposit station (2, 3, 4) by means of a related single conveyor (5, 6, 7). Each single conveyor (5, 6, 7) comprises a plurality of gripping devices which are disposed one behind the other and can be controlled individually. At the deposit stations (2, 3, 4) these gripping devices are now opened whereby the released printed products are deposited on the collecting conveyor (1) which is situated therebelow. This collecting conveyor (1) is likewise provided with controllable gripping devices which seize and entrain the deposited printed prducts. At each deposit station (2, 3, 4) the printed products are placed over the printed product or products previously deposited on the collecting conveyor (1). The piles of superposed printed products are delivered to a processing station (11). In this manner the printed products may be collected or gathered together without stacking of these printed products being necessary at the deposit stations (2, 3, 4).

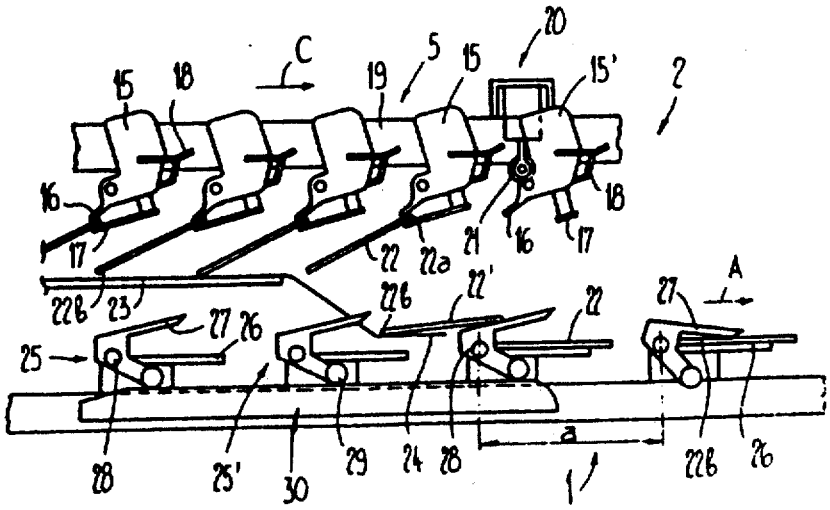

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claims 1 and 12 are determined to be patentable as amended.

Claims 3–10 and 11, dependent on an amended claim, is determined to be patentable.

New claims 13–26 and 27 are added and determined to be patentable.

1. A device for superposing individual substantially flat products, comprising:

at least two product deposit stations arranged one behind the other;

a collecting conveyor having entrainment members disposed at intervals thereon, each said entrainment member being operatively associated with a receiving surface for supporting the flat products in superposed relationship one on top of the other and defining a related operative region;

said collecting conveyor running in a predetermined conveying direction through said deposit stations for receiving products on said receiving surfaces;

a predetermined number of linearly extending single conveyors, each of which is operatively associated with a related one of said deposit stations for conveying thereto the products which have a leading edge and a trailing edge, and for depositing said products on said collecting conveyor;

each said single conveyor comprising:

controllable gripping devices disposed one behind the other and extending in the region of the associated deposit station above the collecting conveyor;

the gripping devices having a conveyance direction which is substantially in the same direction as the conveying direction of the collecting conveyor; [and]

means for bringing the trailing edge of the products delivered by the single conveyors into the operative region of the entrainment members of the collecting conveyor[.] ;

*means for driving said collecting conveyor at a predetermined conveying speed in the conveying direction thereof;*

*means for driving each said single conveyor at a predetermined conveyance speed in said conveyance direction so that the products assume a speed substantially equal to said conveyance speed of the related single conveyor; and*

*means for ensuring that before the products are entrained by the entrainment members, the conveying speed of the collecting conveyor is greater than the speed of the products to be deposited in the conveying direction of the collecting conveyor.*

12. A device for superposing individual substantially flat products comprising:

at least two product deposit stations;

a collecting conveyor which runs through the deposit stations in a predetermined conveying direction and has entrainment members disposed at intervals thereon, each said entrainment member defining a related operative region;

a predetermined number of single conveyors each of which is operatively associated with a related one of said deposit stations for conveying thereto the products which have a trailing edge and for depositing said products on said collecting conveyor;

each said single conveyor comprising:

controllable gripping devices disposed one behind the other and extending in the region of the associated deposit station above the collecting conveyor;

the gripping devices having a conveyance direction which is substantially in the same direction as the conveying direction of the collecting conveyor;

means for bringing the trailing edge of the products delivered by the single conveyors into the operative region of the entrainment members of the collecting conveyor; [and]

said entrainment members comprising controlled gripping devices each having an upper gripping jaw which is upwardly pivotable in order to open the related gripping device[.] ;

*means for driving said collecting conveyor at a predetermined conveying speed in the conveying direction thereof;*

*means for driving each said single conveyor at a predetermined conveyance speed in said conveyance direction so that the products assume a speed substantially equal to said conveyance speed of the related single conveyor; and*

*means for ensuring that before the products are entrained by the entrainment members, the conveying speed of the collecting conveyor is greater than the speed of the products to be deposited in the conveying direction of the collecting conveyor.*

*13. A device for superposing individual substantially flat products, comprising:*

*at least two product deposit stations;*

*a collecting conveyor defining a conveying direction and running through the deposit stations arranged one behind the other in the conveying direction of the collecting conveyor for receiving products deposited thereon, the collecting conveyor having entrainment members disposed at intervals thereon, each entrainment member defining an operative region and serving to engage trailing eges of the flat products, a distance between adjacent entrainment members in the conveying direction being smaller than a length of at least some of the flat products in the conveying direction of the collecting conveyor, and the entrainment members forming a support for the flat products which overlap one entrainment member and are entrained by another entrainment member following the one entrainment member in the conveying direction;*

*a single conveyor associated with each of the deposit stations for conveying the flat products and depositing the flat products on the collecting conveyor;*

*each single conveyor comprising:*

*a plurality of controllable gripping devices disposed one behind the other and extending in a region of the associated deposit station above the collecting conveyor and serving to seize leading edges of the flat products;*

*the gripping devices having, at least in the region of the deposit stations, a conveying direction which is substantially in the same direction as the conveying direction of the collecting conveyor, and releasing devices disposed at each of the deposit stations for opening the gripping devices of the associated single conveyor, at least some of the releasing devices opening the gripping devices only when the trailing edges of the corresponding flat products reach the operative region of the entrainment members; and*

*support means for retaining the trailing edges of the flat products in a path of travel of the entrainment members.*

*14. The device as claimed in claim 13, wherein the distance between the entrainment members is greater than the distance between the gripping devices of the single conveyors.*

15. The device as claimed in claim 13, wherein a conveying speed of the collecting conveyor is greater than a conveying speed of the single conveyors when the gripping devices are opened and the flat products therein are seized by the entrainment members.

*16. The device as claimed in claim 13, further comprising restraining means acting upon the product for preventing entrainment of the flat products deposited on the collecting conveyor before they are seized by the entrainment members.*

*17. The device as claimed in claim 13, wherein at least a first deposit station in the conveying direction has the support means which comprises a support extending into the path of travel of the entrainment members for the product to be deposited onto the collecting conveyor.*

*18. The device as claimed in claim 13, wherein the entrainment members are controlled gripping devices having opposed gripper jaws.*

*19. The device as claimed in claim 18, wherein in order to open the gripping devices of the collecting conveyor, the gripper jaw which forms the support for the flat products is pivotable relative to the collecting conveyor.*

*20. A device for superposing individual substantially flat products, comprising:*

*at least two product deposit stations;*

*a collecting conveyor defining a conveying direction and running through the deposit stations arranged one behind the other in the conveying direction of the collecting conveyor for receiving products deposited thereon, the collecting conveyor having entrainment members disposed at intervals thereon, each entrainment member defining an operative region and serving to engage trailing edges of the flat products, a distance between the entrainment members in the conveying direction being smaller than a length of at least some of the flat products in the conveying direction of the collecting conveyor, and the entrainment members forming a support for the flat products which overlap one entrainment member and are entrained by another entrainment member following the one entrainment member in the conveying direction;*

*a single conveyor associated with each of the deposit stations for conveying the flat products and depositing the flat products on the collecting conveyor;*

*each single conveyor comprising:*

*a plurality of controllable gripping devices disposed one behind the other and extending in a region of the associated deposit station above the collecting conveyor and serving to seize leading edges of the flat products;*

*the gripping devices having, at least in the region of the deposit stations, a conveying direction which is substantially in the same direction as the conveying direction of the collecting conveyor, and releasing devices disposed at each of the deposit stations for opening the gripping devices of the associated single conveyor, a conveying speed of the collecting conveyor when the gripping devices are opened and the flat products therein are seized by the entrainment members being greater than the speed of the products released by the single conveyors.*

*21. The device as claimed in claim 20, further comprising support means for retaining the trailing edges of the flat products in a path of travel of the entrainment members.*

*22. The device as claimed in claim 20, wherein the distance between the entrainment members is greater than the distance between the gripping devices of the single conveyors.*

*23. The device as claimed in claim 20, wherein at least some of the releasing devices open the gripping devices only when the trailing edges of the corresponding flat products reach the operative region of the entrainment members.*

*24. The device as claimed in claim 20, further comprising restraining means acting upon the product for preventing entrainment of the flat products deposited on the collecting conveyor before they are seized by the entrainment members.*

*25. The device as claimed in claim 21, wherein at least a first deposit station in the conveying direction has the support means which comprises a support extending into the path of travel of the entrainment members for the product to be deposited onto the collecting conveyor.*

26. The device as claimed in claim 20, wherein the entrainment members are controlled gripping devices having opposed gripper jaws.

*27. The device as claimed in claim 26, wherein in order to open the gripping device of the collecting conveyor, the gripper jaw which forms the support for the flat products is pivotable relative to the collecting conveyor.*

* * * * *